United States Patent [19]

Goel

[11] 3,957,367

[45] May 18, 1976

[54] COLOR ELASTROSTATOGRAPHIC PRINTING MACHINE

[75] Inventor: Narendra S. Goel, Henrietta, N.Y.

[73] Assignee: Xerox Corporation, Stamford, Conn.

[22] Filed: Sept. 16, 1974

[21] Appl. No.: 506,652

[52] U.S. Cl. ..... 355/4
[51] Int. Cl.² ..... G03G 15/01
[58] Field of Search ..... 355/4

[56] References Cited

UNITED STATES PATENTS

| | | | |
|---|---|---|---|
| 3,531,195 | | Seisakusho | 355/4 |
| 3,838,919 | 10/1974 | Takahaski | 355/4 |
| 3,893,761 | 7/1975 | Buchan et al. | 355/3 R |

FOREIGN PATENTS OR APPLICATIONS

| | | | |
|---|---|---|---|
| 1,077,831 | 8/1967 | United Kingdom | 355/4 |

*Primary Examiner*—John Gonzales
*Attorney, Agent, or Firm*—H. Fleischer; J. J. Ralabate; C. A. Green

[57] ABSTRACT

A color electrostatographic printing machine in which successive single color powder images are transferred, in superimposed registration with one another, to an intermediary. This multi-layered powder image is fused on the intermediary and transferred therefrom to a sheet of support material forming a copy of the original document.

15 Claims, 3 Drawing Figures

COLOR ELASTROSTATOGRAPHIC PRINTING MACHINE

The foregoing abstract is neither intended to define the invention disclosed in the specification, nor is it intended to be limiting as to the scope of the invention in any way.

BACKGROUND OF THE INVENTION

This invention relates generally to an electrostatographic printing machine, and more particularly concerns improved transfer and fusing systems for use therein.

In the process of electrostatographic printing, an electrostatic latent charge pattern is reproduced in viewable form. The field of electrostatography includes electrophotography and electrography. Electrophotography employs a photosensitive medium to form, with the aid of electromagnetic radiation, an electrostatic latent charge pattern. Electrography utilizes an insulating medium to form without the aid of electromagnetic radiation, the electrostatic latent charge pattern. In both of the foregoing processes, the electrostatic latent image is developed with toner particles which are ultimately transferred to a sheet of support material. Hereinafter, an electrophotographic printing machine will be described as an illustrative embodiment of the foregoing process. This printing machine incorporates the features of the present invention therein.

In the process of electrophotographic printing, for example, as disclosed in U.S. Pat. No. 2,297,691 issued to Carlson in 1942, an image bearing member or photosensitive element having a pnotoconductive insulating layer is charged to a substantially uniform potential to sensitize the surface thereof. Subsequently, the charged photoconductive surface is exposed to a light image of the original document. The light image selectively dissipates the charge in the irradiated areas of the photoconductive surface in accordance with the light intensity projected thereon. This creates an electrostatic latent image on the photoconductive surface. Development of the electrostatic latent image recorded on the photoconductive surface is achieved by bringing a developer mix into contact therewith. Typical developer mixes comprise dyed or colored thermoplastic particles, known in the art as toner particles, which are mixed with coarser carrier beads, such as ferromagnetic granules. The developer mix is selected such that the toner particles have the appropriate charge relative to the electrostatic latent image recorded on the photoconductive surface.

In multi-color electrophotographic printing, the light image employed to irradiate the charged photoconductive surface is filtered to form a single color electrostatic latent image thereon. Each single color electrostatic latent image is developed with toner particles of a color complementary to the color of the filtered light image. Thereafter, the different color toner powder images formed on the photoconductive surface are transferred to the sheet of support material in superimposed registration with one another. Generally, the multilayered toner powder image is permanently affixed to the sheet of support material forming a color copy thereon. The foregoing process is described generally in U.S. Pat. No. 3,799,668 issued to McVeigh in 1974. In this type of process, the sheet of support material is secured onto an electrically biased roll which rotates in synchronism with the photoconductive drum.

The toner powder images developed on the photoconductive drum are transferred to the sheet of support material secured to the electrically biased transfer roll. Generally three toner powder images are transferred, in superimposed registration with one another, from the photoconductive drum to the sheet of support material. The sheet of support material is usually secured by mechanical gripping means to the electrically biased roll. This gripping apparatus frequently does not permit copying to the edges of the sheet of support material.

In addition, this degradates the quality of duplex copies. More particularly, in duplex printing a toner powder image is transferred to the side of the sheet opposed from the first copy. The fused toner powder image of the first copy acts as a dielectric layer reducing the transfer fields and the efficiency of the transfer process. Thus, the toner powder images may not be totally transferred to the side opposed from the first copy resulting in low quality duplex copy.

Various systems have been proposed to overcome this problem. By way of example, an intermediate roller may be employed. In devices of this nature, successive toner powder images are transferred, in superimposed registration with one another, from the photoconductive drum to an intermediate roller. In many cases, such systems employ three photoconductive drums, one for each of the toner powder images being forwarded, U.S. Pat. No. 3,392,667 issued to Cassell et al. in 1968 and U.S. Pat. No. 3,399.611 issued to Lusher in 1968 describe printing machines of this type. However, systems of this type have other problems. For example, the transfer efficiency of the multi-layered toner powder image in contact with the intermediate roller is low. This frequently produces unacceptable color shifts in the final fused powder image on the sheet of support material. In addition, when the multilayered toner powder image is fused to the sheet of support material the power requirements are significant. For example, approximately 60% to 80% of the power employed in the powder image is used to heat the sheet of support material. Moreover, when the sheet of support material is a transparency, hollow characters frequently result due to inefficiencies in the transfer apparatus. Nor does this solve the duplexing problem.

Accordingly, it is the primary object of the present invention to improve color electrostatographic printing machines decreasing the fuser power requirements and improving duplexing capabilities.

SUMMARY OF THE INVENTION

Briefly stated, and in accordance with the present invention, there is provided an electrostatographic printing machine for reproducing original documents on a sheet of support material.

Pursuant to the features of the present invention, a plurality of single color powder images are formed, in superimposed registration with one another, on a receiving member. The superimposed powder images are fused on the receiving member. Thereafter, the fused powder image is transferred to the sheet of support material creating a color copy of the original document thereon.

BRIEF DESCRIPTION OF THE DRAWINGS

Other objects and advantages of the present invention will become apparent upon reading the following detailed description and upon reference to the drawings, in which.

While the present invention will be described in connection with a preferred embodiment thereof, it will be understood that it is not intended to limit the invention to that embodiment. On the contrary, it is intended to cover all alternatives, modifications and equivalents as may be included within the spirit and broad scope of the invention as defined by the appended claims.

DETAILED DESCRIPTION OF THE INVENTION

Figure 1:
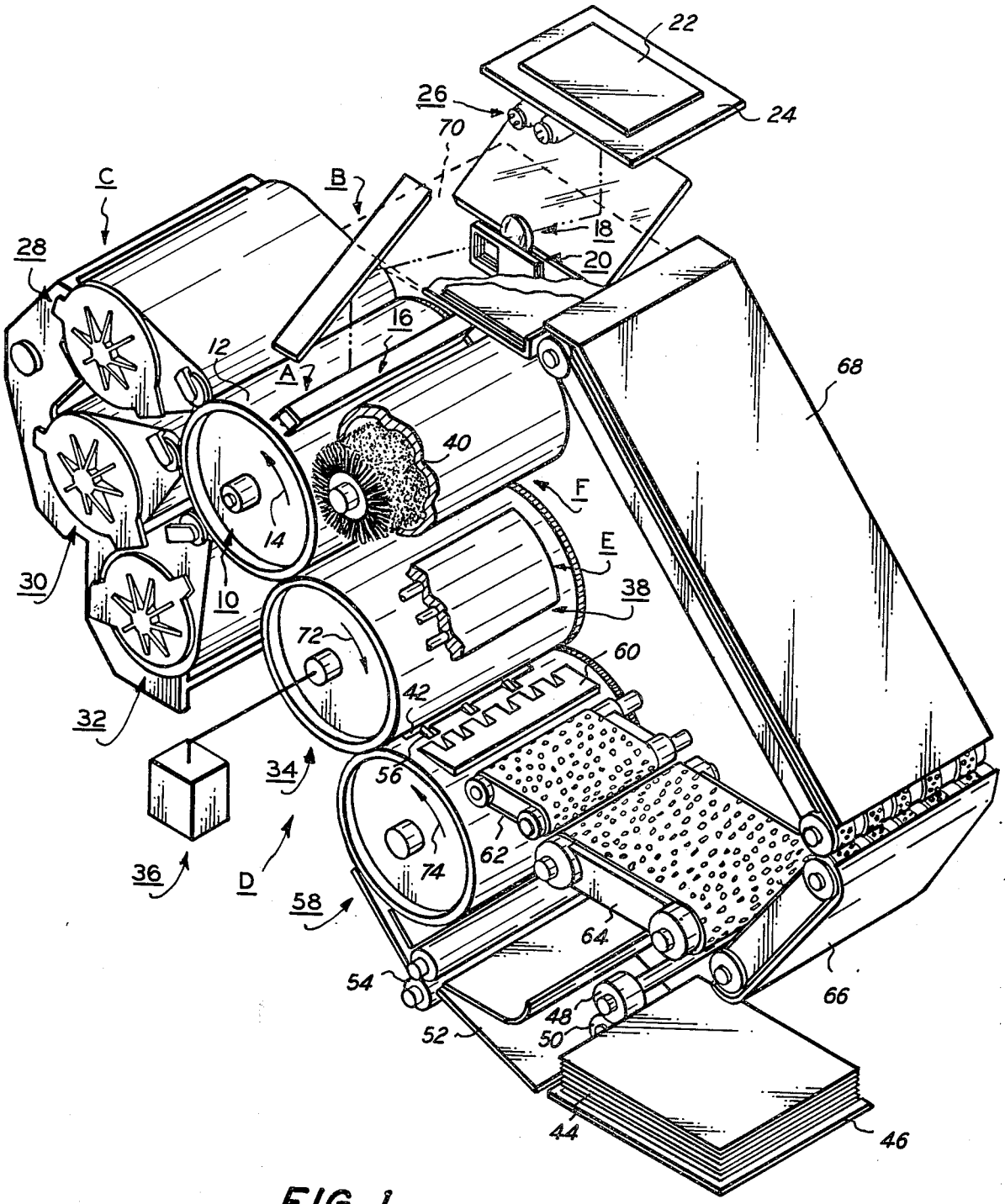
FIG. 1 is a schematic perspective view depicting a color electrophotographic printing machine incorporating the features of the present invention therein.

For a general understanding of an electrophotographic printing machine, in which the present invention may be incorporated, reference is had to FIG. 1 which depicts schematically the various system components therein. Throughout this description, like reference numerals will be employed to designate like elements. Although the features of the present invention are particularly well adapted for use in the color electrophotographic printing machine depicted in FIG. 1, it should become evident from the following discussion that they are equally well suited for use in a wide variety of electrostatographic printing machines and are not necessarily limited in their application to the particular embodiment shown herein.

As in all electrophotographic systems of the type illustrated, an image bearing member having a drum 10 with photoconductive surface 12 entrained about and secured to the exterior circumferential surface is rotated, in the direction of arrow 14, through a series of processing stations. One type of suitable photoconductive material is described in U.S. Pat. No. 3,655,377 issued to Sechak in 1972.

Initially, drum 10 rotates photoconductive surface 12 through charging station A. Charging station A has a corona generating device, indicated generally by the reference numeral 16, to sensitize photoconductive surface 12. As shown in FIG. 1, corona generating device 16 is positioned closely adjacent to photoconductive surface 12 and charges it to a relatively high substantially uniform potential. One type of suitable corona generating device is described in U.S. Pat. No. 2,778,946 issued to Mayo in 1957.

Thereafter, the charged photoconductive surface 12 is rotated to exposure station B. At exposure station B, a color filtered light image of the original document is projected onto the charged photoconductive surface 12. The charge is selectively dissipated in the irradiated areas recording an electrostatic latent image on photoconductive surface 12. Exposure station B includes a moving lens system, generally designated by the reference numeral 18, and a color filter mechanism shown generally at 20. Suitable moving lens systems and color filter mechanisms are described in U.S. Pat. No. 3,062,108 issued to Mayo in 1962, and U.S. Pat. No. 3,775,006 issued to Hartman in 1973, respectively. In the illustrative machine, an original document 22, such as a sheet of paper, book or the like, is placed face down upon transparent viewing platen 24. Lamp assembly 26, filter mechanism 20 and lens 18 move in a timed relationship with drum 10 to scan successive incremental areas of original document 22 located upon platen 24. In this manner, the charge pattern on photoconductive surface 12 is selectively discharged. This records an electrostatic latent image on photoconductive surface 12 corresponding to a single color of the original document.

After exposure, drum 10 rotates the single color electrostatic latent image recorded on photoconductive surface 12 to development station C. Development station C includes three individual developer units, generally indicated by the reference numerals 28, 30 and 32, respectively. A suitable development station employing a plurality of developer units is disclosed in co-pending U.S. application Ser. No. 255,259 filed in 1972, the relevant portions thereof being hereby incorporated in the present application. Each of the developer units comprise a magnetic brush roller adapted to position a developer mix of carrier beads and toner particles in contact with the electrostatic latent image recorded on photoconductive surface 12. The carrier beads are generally made from a ferromagnetic material, such as steel or nickel, while the toner particles are usually made from a heat settable thermoplastic material. The distinctions between each of the developer units resides primarily in the fact that they contain differently colored toner particles therein. For example, developer unit 28 may contain yellow toner particles, developer unit 30, magenta toner particles, and developer unit 32, cyan toner particles. Each developer unit is activated sequentially to deposit toner particles, complementary in color to the filtered light image, on the electrostatic latent image. Thus, an electrostatic latent image formed from a green filtered light image is rendered visible by depositing magenta toner particles thereon. Similarly, latent images formed from blue and red light images are developed with yellow and cyan toner particles, respectively. The developed electrostatic latent image is transported on drum 10 to transfer station D.

At transfer station D, the toner powder image adhering electrostatically to photoconductive surface 12 is transferred to a receiving member or a cylindrical roll, indicated generally by the reference numeral 34. Cylindrical roll 34 rotates in synchronism with drum 10. Roll 34 rotates at substantially the same angular velocity as drum 10, both being of substantially the same diameter. Thus, a plurality of toner powder images may be transferred, in superimposed registration with one another, to roll 34. Cylindrical roll 34 is electrically biased to a potential of sufficient magnitude and polarity to attract electrostatically the toner particles from the latent image recorded on photoconductive surface 12 thereto. Roll 34 is electrically excited by voltage source 36. Voltage source 36 is high power voltage source. The structure of cylindrical roll 34 and the manner of operation will be described hereinafter, in greater detail, with reference to FIGS. 2 and 3.

While a cylindrical roll has hereinbefore been described as the receiving member, one skilled in the art will appreciate that other structures may be employed in lieu thereof. By way of example, an endless belt moving in synchronism with drum 10 may receive successive toner powder images therefrom, in superimposed registration with one another.

After the requisite number of toner powder images have been transferred, in superimposed registration onto roll 34, fixing station E is actuated. At fixing station E, a fuser, designated generally by the reference numeral 38, coalesces the toner powder image so as to form a color copy of the original document. Fuser 38 is located in pre-selected position closely adjacent to roll 34, Fuser 38 includes a radiant energy source or heat strips preferably made from nickel chromium alloy ribbon entrained helically between a pair of spaced, opposed ceramic spool supports. One of the ceramic spools is mounted on a leaf spring providing compensation for thermal expansion and contraction of the ribbon. The heat strips are configured to provide substantially uniform radiation, the end elements thereof being arranged to minimize radiation fall off. A pair of reflectors are interposed between the heat strips and the outer shell of the fusing apparatus. The reflectors are, preferably, made from aluminum and are secured to insulation disposed on the outer shell of fuser 38. Fuser 38 is spaced closely to roll 34 and adapted to coalesce the powder image thereon by applying sufficient heat thereto. By way of example, fusing apparatus 38 may furnish anywhere from about 400 to about 800 watts. The necessary wattage is dependent upon the toner particle characteristics and their melt points. A suitable fusing apparatus is described in U.S. Pat. No. 3,781,516 issued to Tsilibes et al. in 1973 the relevant portions thereof being hereby incorporated into the present application.

Returning now to a discussion of the remaining processing stations disposed about the periphery of drum 10, after the toner powder image is transferred to roll 34, invariably some toner particles remain on photoconductive surface 12. These residual toner particles are removed at cleaning station F. Initially, the toner particles are brought under the influence of a corona generating device (not shown) adapted to neutralize the remaining electrostatic charge on photoconductive surface 12 and optimize the charge on the residual toner particles. The toner particles are cleaned from photoconductive surface 12 by a rotatably mounted fibrous brush 40 in contact therewith. A suitable brush cleaning device is described in U.S. Pat. No. 3,590,412 issued to Gerbasi in 1971.

Turning now to the sheet feeding arrangement, as shown in FIG. 1, a sheet of support material 42 is advanced from stack 44 disposed upon tray 46. Feed roll 48, in operative communication with retard roll 50, advances and separates successive uppermost sheets from stack 44. Each advancing sheet moves into chute 52 which directs it into the nip between register rolls 54. Thereafter gripper fingers, indicated generally at 56, mounted on drum 58 secure releasably thereon support material 42 for movement therewith. After a plurality of toner powder images have been fused on roll 34, drum 58 is articulated into contact with roll 34. Roll 34 has a suitable release agent coated on the exterior circumferential surface thereof to promote the release of the fused toner powder image therefrom. Drum 58 is pressed into contact with roll 34 to transfer the fused toner powder images therefrom to support material 42. By way of example, drum 58 may be pressed into contact with roll 34 by a force ranging from about 1 linear pound to about 8 linear pounds. It is evident that the requisite force will be dependent upon the characteristics of the release agent and that of the fused toner powder images. In this manner, the fused toner powder images are transferred to the sheet of support material 42. After the fused toner powder images have been transferred to support material 42, gripper fingers 56 release support material 42 and space it from drum 58. Stripper bar 60 is then interposed between separate support material 42 and drum 58 separating support material 42 therefrom. After the fused toner powder images are transferred to support material 42, endless belt conveyors 62, 64, 66 and 68 advance it to catch tray 70 for subsequent removal from the printing machine by the operator.

In order to eliminate the edge deletions produced when gripper fingers are employed, support material 42 may be electrostatically tacked to drum 58. Additionally, drum 58 may include a plurality of apertures enabling a blower mounted internally therein to produce a vacuum securing support material 42 thereto.

It is believed that the foregoing description is sufficient for purposes of the present application to depict the general operation of a multi-color electrophotographic printing machine incorporating the teachings of the present invention therein.

Figure 2:
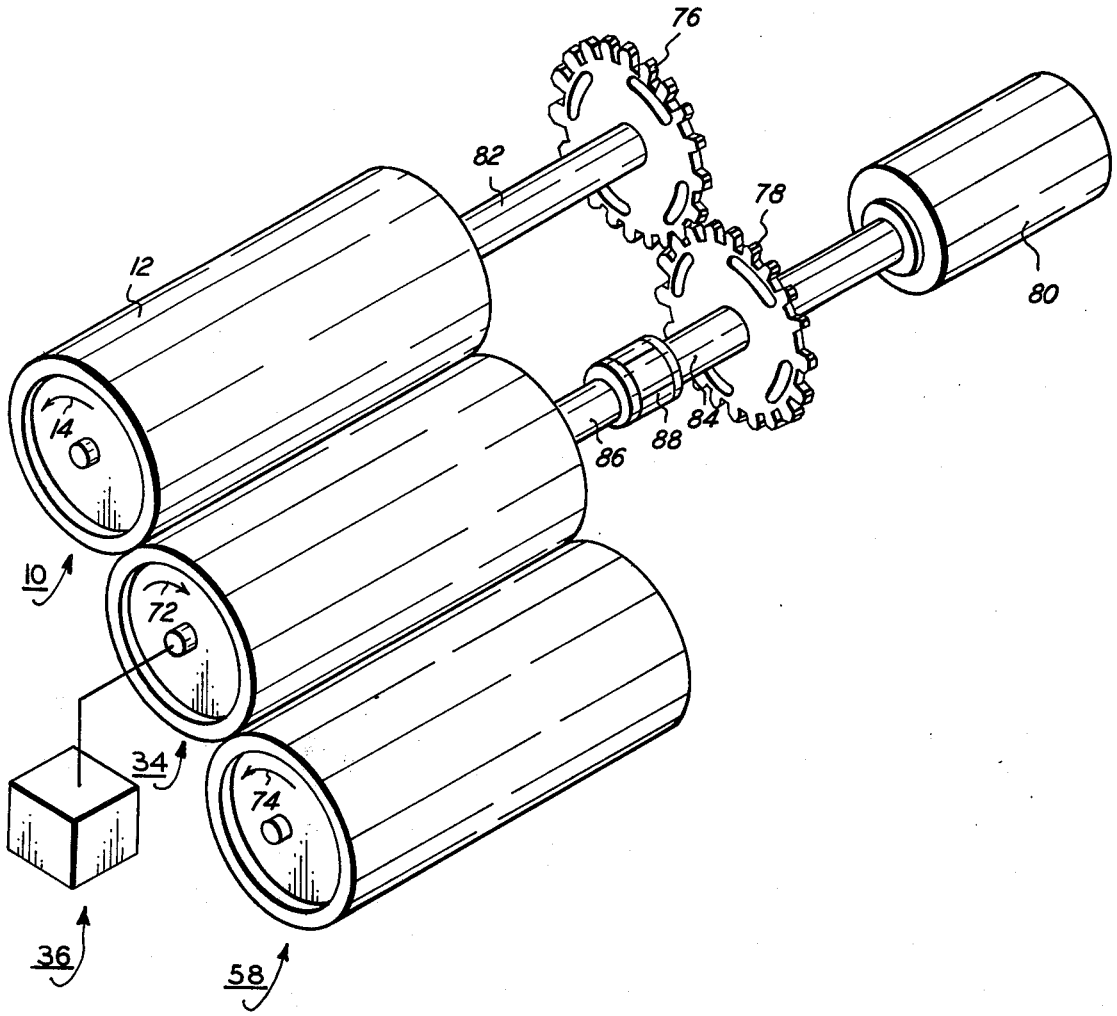
FIG. 2 is a schematic perspective view of the transfer system employed in the FIG. 1 printing machine.

Referring now to the specific subject matter of the present invention, FIG. 2 depicts drum 10, roll 34 and drum 58. As shown therein, drum 10 rotates in the direction of arrow 14, roll 34 rotates in the direction of arrow 72 and drum 58 rotates in the direction of arrow 74. Roll 34 and drum 10 are rotated in a synchronism with one another. The foregoing is achieved by a pair of gears having substantially the same number of teeth. Gears 76 and 78 couple drum 10 to roll 34. Motor 80 drives gear 78 which, in turn, drives gear 76 mounted on shaft 82. Drum 10 is also mounted on shaft 82 and rotates therewith. Gear 78 is mounted on shaft 84, shaft 84 being connected to shaft 86 via coupling 88. By way of example, gear 76 and 78 may be made from a suitable plastic material and have preferably about 48 teeth disposed about the periphery thereof. A suitable gear system for driving drum 10 and roll 34 is disclosed in co-pending U.S. application Ser. No. 370,181 filed in 1973, the relevant portions thereof being hereby incorporated into the present application. It should be noted that motor 80 is a synchronous speed motor and rotates shaft 84 at a substantially constant angular velocity. Roll 34 includes a conductive tube, such as aluminum, having about a ¼ inch layer of urethane cast thereabout. A release layer is sprayed over the layer of cast urethane. By way of example, the release layer is preferably a melamine formaldehyde and silicone coating. This readily permits the fused toner powder image to be transferred from roll 34 to the sheet of support material secured to drum 58. A direct current bias voltage is applied to the conductive tube by a suitable means such as a carbon brush and brass ring assembly (not shown). Voltage source of power supply 36 excites roll 34 at about 3000 volts. However, this voltage may range from about 1500 to about 4500 volts. It should be noted that the transfer voltage applied by voltage source 36 may be suitably adjusted to the optimized value within the preferred range. Drum 58 also includes a conductive tube, such as aluminum, having a layer of urethane cast thereabout. A polyurethane coating is sprayed over the layer of cast urethane. Drum 58 is periodically moved into contact with drum 34 after the multi-layered toner powder image has been fused. Once again, drum 58 is pressed into contact with roll 34, the preferred contact force ranging from about 1 linear pound to about 8 linear pounds. The pressure between drum 58 and roll 34 is sufficient to transfer the toner powder image fused on the release agent of roll 34 to the sheet of support material secured to drum 58.

Figure 3:
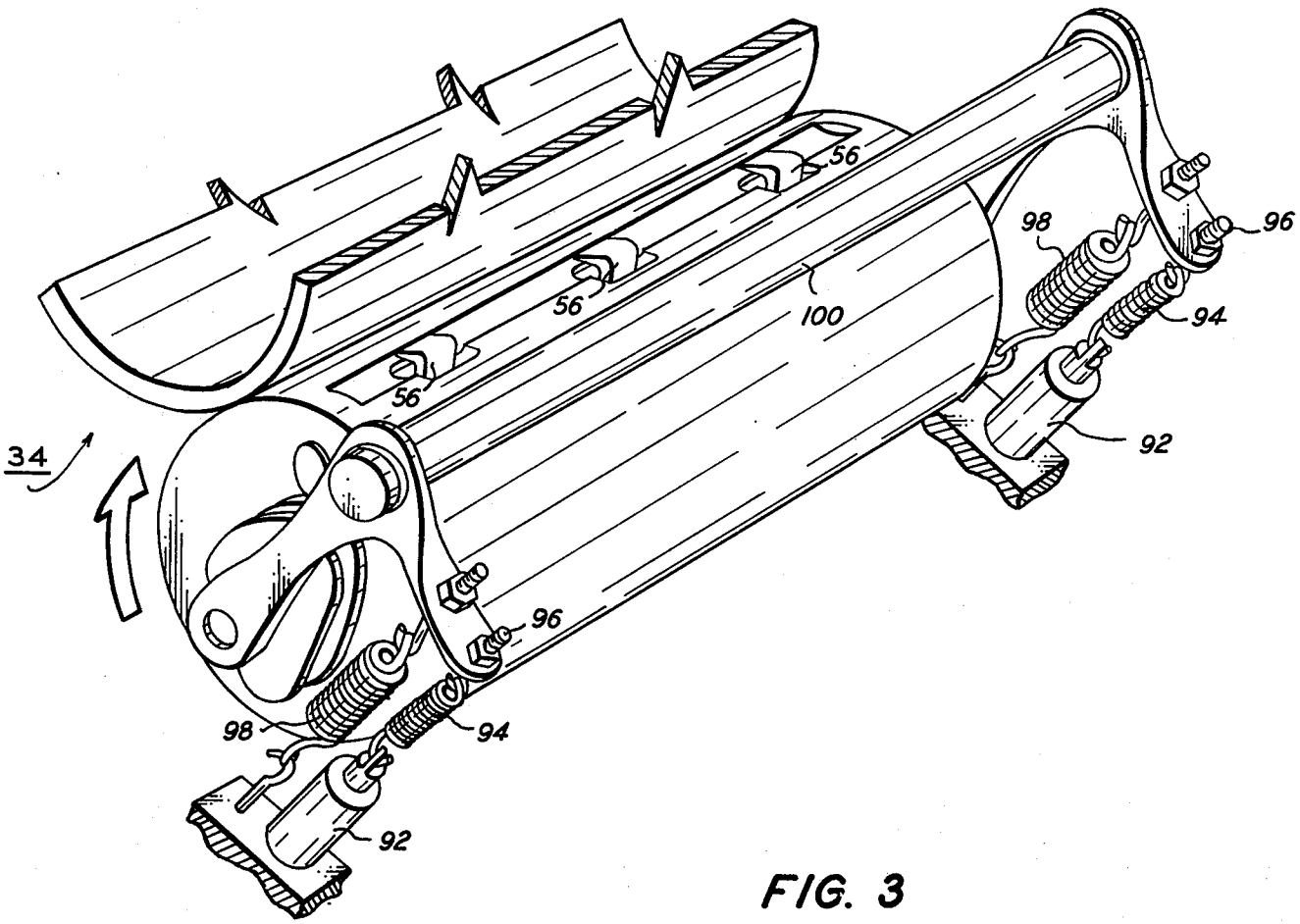
FIG. 3 is a fragmentary perspective view of the intermediate roller and the support material roller employed in the FIG. 2 transfer system.

Referring now to FIG. 3, there is shown the detailed arrangement for moving drum 58 into contact with roll 34. Drum 58 is mounted rotatably in yoke 90. Yoke 90 is mounted preferably on the printing machine frame. In FIG. 3, drum 58 is shown in the operative position contacting roll 34. Drum 58 pivots from an inoperative position spaced from roll 34 to the operative position in contact therewith. The movement of drum 58 is regulated by the logic circuitry. It should be noted that a timing disc (not shown) is mounted on drum 10 (FIGS. 1 and 2). The timing disc includes a plurality of spaced apertures in the periphery thereof, the remainder thereof being opaque. A light source is located on one side of the timing disc and a photosensor on the other side thereof. The timing disc rotates in conjunction with drum 10. Light rays are transmitted through the transparent apertures therein and actuate the photosensor. In this manner, the photosensor triggers the sequence of events at the various processing stations. After the multi-layered toner powder image is fused on the surface of roll 34, drum 58 is moved into contact therewith. The foregoing movement of drum 58 is achieved by solenoid 92. Solenoid 92 is mounted on the machine frame and has one end portion connected to spring 94. The other end portion of spring 94 is connected to an elongated threaded member 96 which is secured to yoke 90. Spring 98 is connected to yoke 90 and also to the machine frame. Spring 98 is extended to counterbalance the weight of drum 58. Thus, drum 58 is substantially free floating. The stroke of solenoid 92 will extend spring 94 and pivot drum 58 about bar 100 into engagement with roll 34. Solenoid 92 is adapted to have a stroke of about 1/2 inch. A stop (not shown) locates drum 58 in the inoperative position spaced from roll 34. Gripper fingers 56 are adapted to secure the sheet of support material to drum 58. After the fused toner powder image is transferred to the sheet of support material, the timing disc, in conjunction with suitable logic circuitry, actuates gripper fingers 56 so as to space the sheet of support material from drum 58. This enables the sheet of support material to be subsequently removed from drum 58 and transported to the catch tray for removal from the printing machine by the operator. The detailed structural configuration of the mechanism for moving drum 58 into contact with roll 34 is described in co-pending U.S. application Ser. No. 399,578 filed in 1973, the relevant portion thereof being hereby incorporated into the present application.

In recapitulation, it is apparent that the multi-colored electrophotographic printing machine described herein achieves the stated aims and objects. This is accomplished by transferring a plurality of toner powder images in superimposed registration with one another, to an intermediate roller. The intermediate roller has a release agent coated on the circumferential surface thereof. The multi-layered toner powder image is fused on the intermediate roller. After the multi-layered toner powder image is fused, the release agent permits the transfer thereof to the sheet of support material. The foregoing reduces the machine power requirements, optimizes transfer and insures that copying may be extended to the edge of the sheet. In addition, this approach insures that both sides of a duplex copy are of uniformly high quality.

It is, therefore, evident that there has been provided in accordance with the present invention an improved electrophotographic printing machine that fully satisfies the objects, aims and advantages set forth above. While this invention has been described in conjunction with specific embodiments thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. A color electrostatographic printing machine arranged to reproduce an original document on a sheet of support material, including:
   - a receiving member;
   - means for forming a plurality of single color powder images, in superimposed registration with one another, on said receiving member;
   - means for fusing the superimposed single color powder images on said receiving member producing a fused color powder image thereon; and
   - first means for transferring the fused color powder image from said receiving member to the sheet of support material creating a color copy of the original document thereon.

2. A printing machine as recited in claim 1, wherein said forming means includes:
   - a member;
   - means for recording successive single color electrostatic latent images on said member;
   - means for developing each single color electrostatic latent image with particles complementary in color thereto forming successive single color powder images on said member; and
   - second means for transferring, in superimposed registration with one another, each single color powder image from said member to said receiving member.

3. A printing machine as recited in claim 2, wherein said second transfer means includes means for electrically biasing said receiving member to electrostatically attract successive single color powder images from said member to said receiving member.

4. A printing machine as recited in claim 3, wherein said first transfer means includes means for pressing the sheet of support material into contact with the fused powder image on said receiving member to effect transfer of the fused powder image from said receiving member to the sheet of support material.

5. A printing machine as recited in claim 4, wherein said fusing means includes means for heating the multi-layered powder image deposited on said receiving member to a pre-selected temperature sufficient for the fusing thereof.

6. A printing machine as recited in claim 5, wherein:
   - said member includes a substantially cylindrical drum; and
   - said receiving member includes a substantially cylindrical roll positioned closely adjacent to said drum.

7. A printing machine as recited in claim 6, further including means for rotating said drum and said roll in synchronism with one another so that successive single color powder images may be transferred, in superimposed registration with one another, from said drum to said roll.

8. A printing machine as recited in claim 7, wherein said first transfer means includes:
   - a transfer roll having the sheet of support material secured releasably thereto; and
   - means for rotating said transfer roll in synchronism with said roll so that the fused powder image may be transferred to the sheet of support material secured thereto.

9. A color electrophotographic printing machine adapted to reproduce an original document on a sheet of support material, including:

a photoconductive member;

means for charging said photoconductive member to a substantially uniform potential;

means for exposing said charged photoconductive member to successive single color light images of the original document recording successive single color electrostatic latent images thereon;

means for developing each single color electrostatic latent image with toner particles complementary in color thereto forming successive single color toner powder images on said photoconductive member;

a receiving member operatively associated with said photoconductive member;

first means for transferring, in superimposed registration with one another, successive single color toner powder image from said photoconductive member to said receiving member;

means for fusing the superimposed single color toner powder images on said receiving member producing a fused colored toner powder image thereon; and second means for transferring the fused toner powder image from said receiving member to the sheet of support material.

10. A printing machine as recited in claim 9, wherein said first transfer means includes means for electrically biasing said receiving member to electrostatically attract successive single color toner powder images from said photoconductive member to said receiving member.

11. A printing machine as recited in claim 10, wherein said second transfer means includes means for pressing the sheet of support material into contact with the fused toner powder image on said receiving member to effect transfer of the fused toner powder image from said receiving member to the sheet of support material.

12. A printing machine as recited in claim 11, wherein said fusing means includes means for heating the multi-layered powder image deposited on said receiving member to a pre-selected temperature sufficient for the fusing thereof.

13. A printing machine as recited in claim 12, wherein:

said photoconductive member includes a substantially cylindrical drum having a photoconductive layer secured to and entrained thereabout; and said receiving member includes a substantially cylindrical roll positioned closely adjacent to said drum.

14. A printing machine as recited in claim 13, further including means for rotating said drum and said roll in synchronism with one another so that successive single color toner powder images may be transferred, in superimposed registration with one another, from said drum to said roll.

15. A printing machine as recited in claim 14, wherein said second transfer means includes:

a transfer roll having the sheet of support material secured releasably thereto; and means for rotating said transfer roll in synchronism with said roll so that the fused toner powder image may be transferred to the sheet of support material secured thereto.

* * * * *